US007048366B2

(12) United States Patent
Alexia et al.

(10) Patent No.: US 7,048,366 B2
(45) Date of Patent: May 23, 2006

(54) SECURE PRINTER CARTRIDGE

(75) Inventors: Jean-Marc Alexia, Montrouge (FR); Bruno Debuire, Garches (FR); Dominique Montbrun, Champagne sur Oise (FR); Frédéric L'Hote, Paris (FR)

(73) Assignee: SECAP (Groupe Pitney Bowes) S.A.S., Saint Denis la Plaine (FR)

( * ) Notice: Subject to any disclaimer, the term of this patent is extended or adjusted under 35 U.S.C. 154(b) by 225 days.

(21) Appl. No.: 10/809,296

(22) Filed: Mar. 24, 2004

(65) Prior Publication Data

US 2004/0189758 A1 Sep. 30, 2004

(30) Foreign Application Priority Data

Mar. 25, 2003 (FR) ..... 03 03675

(51) Int. Cl.
*B41J 2/175* (2006.01)

(52) U.S. Cl. ..... 347/87

(58) Field of Classification Search ..... 347/2, 347/5, 86, 87, 214, 19; 705/60, 64, 408
See application file for complete search history.

(56) References Cited

U.S. PATENT DOCUMENTS

| | | | | |
|---|---|---|---|---|
| 6,212,505 | B1 * | 4/2001 | Herbert | 705/408 |
| 6,406,120 | B1 * | 6/2002 | Pauschinger | 347/19 |
| 6,435,676 | B1 * | 8/2002 | Murray et al. | 347/87 |
| 6,866,359 | B1 * | 3/2005 | Pan et al. | 347/19 |
| 2002/0188860 | A1 | 12/2002 | Parry et al. | 713/200 |

FOREIGN PATENT DOCUMENTS

FR 2706655 A 12/1994

* cited by examiner

*Primary Examiner*—Anh T. N. Vo
(74) *Attorney, Agent, or Firm*—George M. Macdonald; Steven J. Shapiro; Angelo N. Chaclas

(57) ABSTRACT

A inkjet printer cartridge is described including at least one print head for printing data on a support, wherein a thin printed circuit is permanently fixed to the printer cartridge and a miniature data processing unit fixed to the printed circuit analyzes a stream of printing commands for controlling the print head to authenticate the data to be printed on the support.

19 Claims, 6 Drawing Sheets

Fig.2
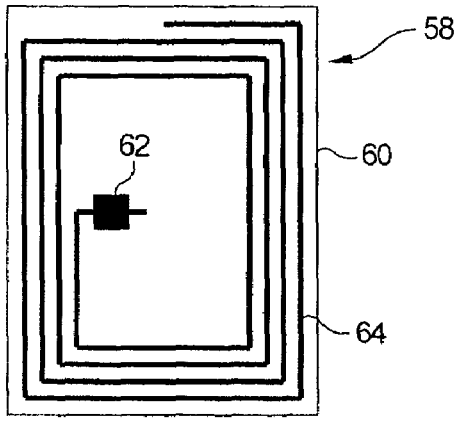
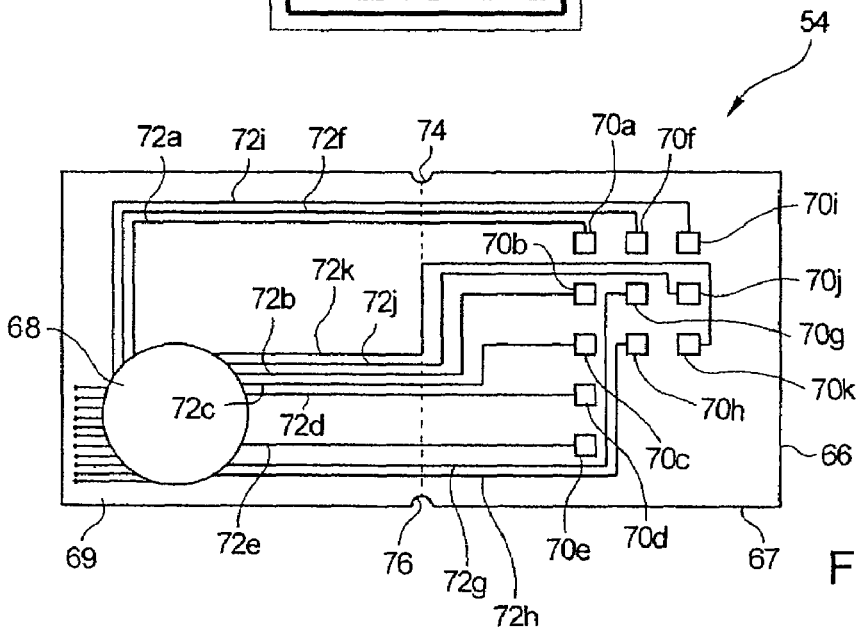
Fig. 3a
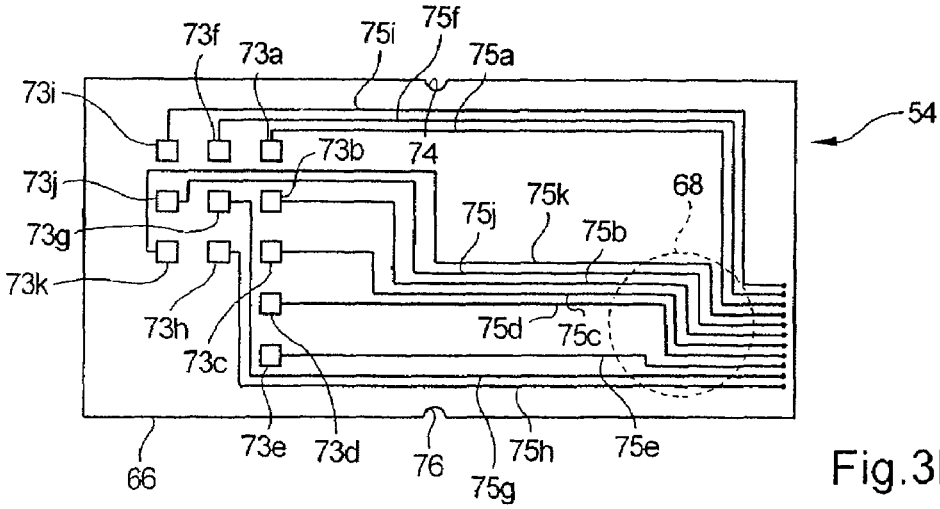
Fig.3b

SECURE PRINTER CARTRIDGE

BACKGROUND OF THE INVENTION

The present invention relates to an inkjet printer cartridge including at least one print head for printing data on a support.

In the field of printing, printer units such as printers that include at least one monochrome or color printer cartridge are used in a manner that is known to the person skilled in the art for inkjet printing of data onto a support such as a sheet of paper.

On the inkjet printer cartridge there is usually a thin printed circuit including electrical contact areas connected by conductive tracks to a print head provided with nozzles for ejecting ink.

The printer unit includes a carriage forming a cartridge support and on which the printer cartridge is installed, the carriage moving in translation to print data onto a sheet of paper. This is known in the art.

The printer unit also includes a printing management electronic circuit card connected to the carriage by a ribbon cable.

When the printer cartridge is installed on the carriage, the electrical contact areas thereof are in contact with contact areas of the ribbon cable connecting the carriage to the card.

Accordingly, printing commands from the printing management electronic circuit card are transmitted via the ribbon cable and reach the contact areas of the thin printed circuit on the cartridge, where they are routed directly to the print head to control the printing of data.

The thin printed circuit on the cartridge is a passive circuit and guarantees continuity of the electrical signals transmitted to the cartridge.

These printer cartridges which are available off the shelf are entirely standardized consumable products whose service life is generally of the order of a few months.

The data transmitted to the printer cartridge is sometimes deemed to be sensitive, for example because it is confidential or represents sums of money.

The latter situation is encountered, for example, in the field of franking machines, where franking data representative of a monetary value is transmitted from a unit that generates the data to a printer unit for printing the franking data on an envelope.

Accordingly, in this field, as in all other fields in which sensitive data is printed on a support, the problem arises of securing data during transfer of data between the source of sensitive data and the printer cartridge.

To this end, the data can be encrypted in the source, for example, and decrypted in the printer unit before transmitting it to the printer cartridge.

However, the decrypted data can nevertheless still be intercepted by a fraudster.

It would be equally possible to provide a specific printer cartridge that includes a data decrypting circuit and that is rendered inaccessible from the outside, for example by embedding it in resin.

However, this necessitates modification of the printer cartridge and even the printing system itself.

The problem of securing data is therefore even more difficult to solve when the technology of the printer cartridges and the corresponding printer units must not be called into question and when it is preferable to be able to continue to use printer cartridges and printer units available off the shelf.

It would therefore be beneficial to be able to secure sensitive data to be printed without modifying the printing technology.

SUMMARY OF THE INVENTION

To this end, the invention proposes an inkjet printer cartridge including at least one print head for printing data on a support, characterized in that a thin printed circuit is permanently fixed to the printer cartridge and a miniature data processing unit fixed to said printed circuit analyzes a stream of printing commands for controlling the print head to authenticate the data to be printed on the support.

By fixing the printed circuit to a standard printer cartridge, the processing unit attached to said circuit is able to analyze printing commands and more particularly to control the validity of data that might have been tampered with before reaching the cartridge.

Because the printed circuit and the processing unit are thin, this is possible without having to modify the shape of the cartridge and the cartridge support.

The circuit and the processing unit therefore add very little to the overall bulk of the printer cartridge equipped in this way.

Moreover, it would be virtually impossible for a fraudster to insert any kind of equipment between the circuit and the printer cartridge, given that they are fastened together and that the circuit would be damaged if any attempt were made to remove it.

The invention therefore improves the security of data compared to the prior art.

Moreover, authenticating data to be printed authenticates the sender of the data.

According to one feature, the printed circuit is flexible, i.e. it bends easily.

This can be particularly advantageous if the circuit has to be fixed to a non-plane surface of the cartridge.

According to another feature, the processing unit includes means for verifying the presence in the stream of printing commands of data for authenticating data to be printed.

Authentication data is inserted into the stream of data to be printed and, for example, is extracted by the processing unit to verify its authenticity.

According to one feature, the processing unit includes means for verifying the integrity of data to be printed to ensure that it has not been intercepted and tampered with by a third party.

This constitutes an additional degree of security.

According to one feature, the processing unit includes means for deciding whether or not to authorize the printing of data according to the result obtained by the verification means.

Accordingly, in the event of a positive verification result, it is decided to authorize printing of the data to be printed but the authentication data itself will not be printed.

On the other hand, if the printing data has been tampered with (negative verification result), the processing unit will decide not to print the data, or to print the data incompletely or with a mark indicating that the printing is not authorized.

According to one feature, the energy necessary for the processing unit to function is obtained from the stream of printing commands.

Accordingly, with the invention, it is not necessary to provide a source of energy on the printed circuit, which simplifies its structure and reduces its manufacturing cost.

This aspect of the invention is therefore particularly advantageous in that the manufacturing cost of the printed circuit is relatively low compared to that of a standard printer cartridge.

Furthermore, the self-powering of the processing unit guarantees a certain independence from the printing system.

According to one feature, the data processing unit is implemented in programmed logic, which reduces power consumption and therefore diverts as little energy as possible from the stream of printing commands. Diverting too much energy from the stream of printing commands would visually degrade the printed data.

The data processing unit could use a microprocessor provided that there is no risk of the energy diverted from the stream of printing commands degrading the printing of data.

According to one feature, the printed circuit is glued to the exterior surface of the printer cartridge.

Nevertheless, the circuit can equally be fixed by other means, such as by welding or by any other mechanical fastening means.

According to one feature, in known manner the cartridge has on its exterior surface electrical contacts connected to the print member in order to transmit to it printing commands for printing data on the support.

According to another feature, the printed circuit has a first portion carrying electrical contacts adapted to receive the stream of printing commands and connected to the data processing unit and which is on a first region of the exterior surface of the cartridge.

According to one feature, the printed circuit has a second portion on which the data processing unit is mounted and which is on a second region of the exterior surface of the printer cartridge.

The printed circuit needs to be flexible if the two regions of the exterior surface of the cartridge are not in the same plane or if one of the regions is not plane.

According to one feature, the second portion of the printed circuit is on a second region of the exterior surface of the printer cartridge which, when said printer cartridge is integrated into a printer unit, forms with the components of said unit sufficient space to accommodate the data processing unit.

The circuit and the processing unit are therefore optimally adapted to the shape of the cartridge and the cartridge support in the printer unit.

According to one feature, the printed circuit is double-sided, which reduces its overall bulk.

According to one feature, one of the faces of the circuit in contact with the cartridge includes electrical contact areas connected to the electrical contacts connected to the print head and to the data processing unit on the opposite face of the circuit.

Thus the circuit is perfectly adapted to the existing technology of printer cartridges as it has means for interfacing it to the cartridge.

According to another feature, the opposite face carrying the data processing unit includes electrical contacts adapted to receive the stream of printing commands.

According to one feature, the data processing unit is thin, so that it does not modify the overall bulk of the cartridge adapted in this way.

According to one feature, the total thickness of the processing unit and the printed circuit is less than or equal to 1.5 mm.

The invention also provides a data printing unit that includes an inkjet printer cartridge conforming to the foregoing brief description.

Thus the invention secures in a very reliable manner the printing of sensitive data without calling into question the printing technology.

The invention also provides a franking machine including a unit for generating franking data to be printed and a printer unit receiving franking data from the franking unit, characterized in that the printer unit includes an inkjet printer cartridge conforming to the foregoing brief description.

Thus the invention secures franking machines in a very reliable manner without calling into question the printing technology.

DESCRIPTION OF THE DRAWINGS

Other features and advantages of the invention will become apparent in the course of the following description, which is given by way of nonlimiting example only, and with reference to the appended drawings, in which:

FIG. 2 is a diagrammatic view of an identification module 58 of a printer cartridge according to the invention;

FIGS. 3*a* and 3*b* are diagrammatic views of two opposite faces of an intelligent module 54 of a printer cartridge according to the invention;

DETAILED DESCRIPTION

Figure 1:
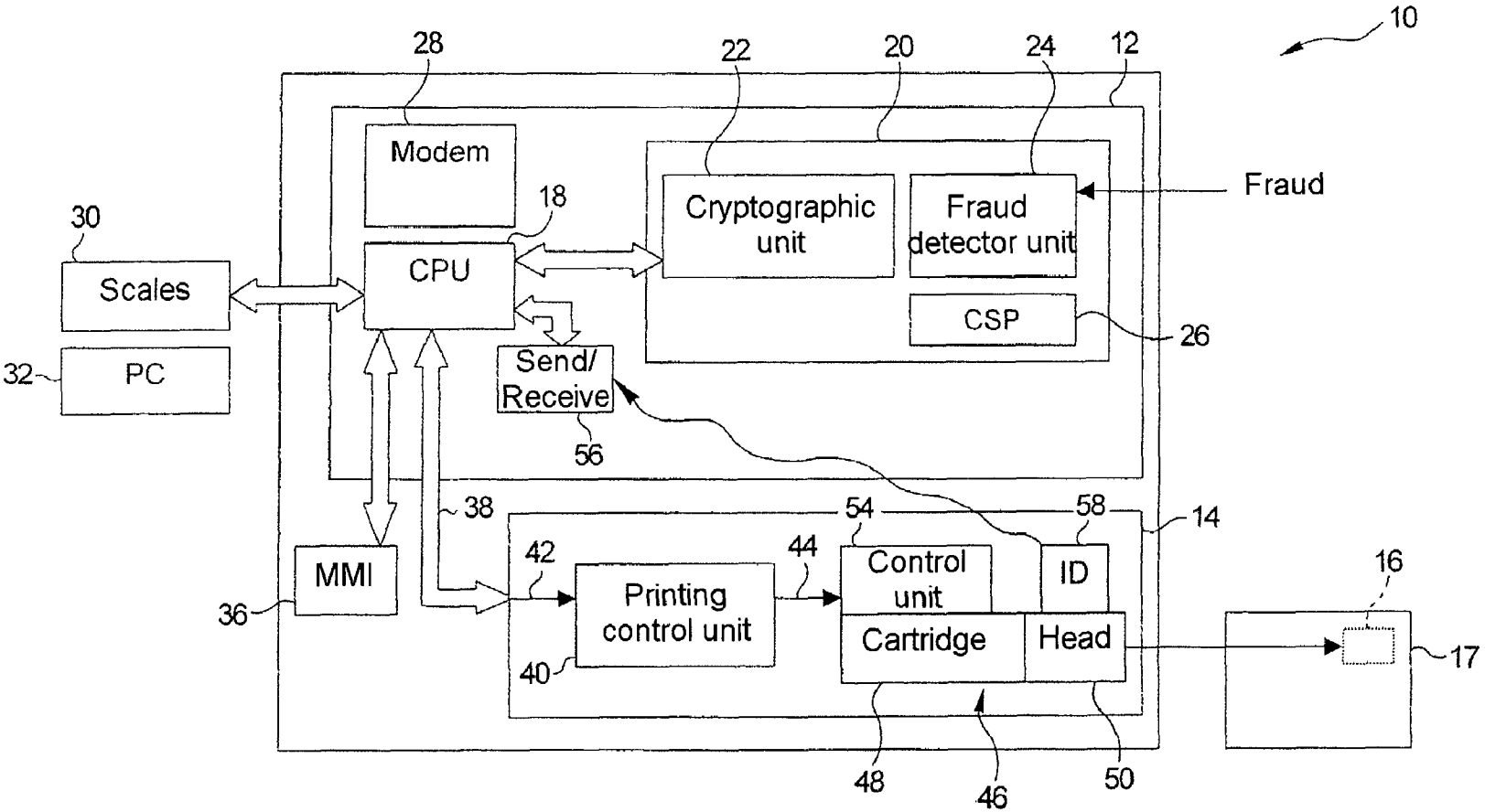
FIG. 1 is a diagrammatic representation of the architecture of a franking machine including a printer cartridge according to the invention.

The embodiment shown schematically in FIG. 1 represents the general architecture of a franking machine 10 integrating a printer cartridge according to the invention.

This machine generally includes two entities: a unit 12 for generating franking data and a unit 14 for printing data that receives franking data from the unit 12 in order to print it, for example in the form of a franking mark 16 on an envelope 17.

To be more specific, the unit 12 has the following functions:

composing the franking mark;

sending data to be printed to the printer unit 14 (scheduling printing of the franking mark);

managing accounting data, in the sense of managing the totalizing counter of franking amounts and imprint counters;

checking the consistency of the accounting data, which ensures the reliability of the data record for each franking cycle; and guaranteeing the integrity, confidentiality and availability of the accounting data.

As shown in FIG. 1, the unit 12, also known as a meter, includes a central data processing unit 18 that communicates with a module 20 including a cryptographic circuit 22 containing the algorithm or algorithms necessary for encrypting data, a fraud detector circuit 24 which, for example, detects attempted opening of the cover of the franking machine, for example, by means of mechanical or optical contacts, for example, and a CSP circuit 26 that is informed of attempted fraud by the circuit 24 and then deletes critical data such as the encryption keys or algorithms, for example.

The unit 12 also includes a modem 28 enabling the postal services to read the meters of the franking machine by telephone, for example for billing purposes.

The central unit 18, which includes in particular a processor or microprocessor, also communicates with scales 30 for weighing postal packets to be franked.

FIG. 1 also shows other external devices, for example a device 32, such as an electronic circuit card (PC option), for example, for emulating the man-machine interface (MMI) 36 integrated into the franking machine 10, and which conventionally includes a keyboard and a screen (not shown).

The unit 12 for generating franking data communicates with the printer unit 14 via a communication mode, for example, of cable type which is based on a USB connection 38.

Data and signals are exchanged, in known manner, between the other components of the franking machine and with external devices via cable connections.

The central unit 18 communicates in particular with the module 20, the external devices 30, 32, and the man-machine interface 36 via cable connections.

The printer unit 14, which is a printer, for example, includes a printing control module 40 which receives from the unit 12 a stream of franking data to be printed and an encrypted signature 42 and converts the data received into a stream of printing commands 44 that is then sent to one or more printer cartridges 46 for printing franking data in the form of the franking mark 16.

Figure 4A:
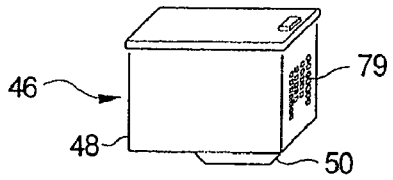
FIGS. 4*a* to 4*h* show successive operations of fitting out a printer cartridge according to the invention.

To be more specific, the printer cartridge 46 includes an ink reservoir 48 and a print head 50 for printing data (FIGS. 1 and 4*a*).

The commands for printing the stream 44 control the print head 50 for printing the franking mark 16 on the support 17.

The printer cartridge 46 is rendered intelligent by the presence of a module 54 affixed to it and described in more detail later.

The franking machine 10 further includes additional wireless communication means between the printer cartridge 46 and the unit 12, enabling the latter to identify said printer cartridge.

To be more specific, the unit 12 includes a sender module 56 and the printer unit 14 includes a receiver module 58 affixed to the printer cartridge 46.

In this embodiment, wireless communication between the unit 12 and the printer cartridge 46 is performed via radio waves.

The module 58 sends data identifying the printer cartridge to the unit 12.

In this embodiment, the module 58 is a tag identifying the printer cartridge which communicates its identification data by radio when acted on by an electromagnetic field whose source is in the module 56.

When the module 56 wishes to identify a print member in order to check that it is an authorized printer cartridge, it then generates a constant magnetic field directed to the module 58 of the printer cartridge 46 and, by means of a receiver circuit, measures variations in the magnetic field generated by the module 58.

The module 58 amplitude-modulates the electro-magnetic signal, so to speak.

Thus measuring the variations of the electromagnetic field provides data identifying the printer cartridge and therefore enables the nearby printer cartridge to be recognized or not.

This recognition procedure is carried out before the unit 12 for generating data sends franking data to the printer unit 14 for printing.

The frequency of the electromagnetic waves emitted by the module 56 is 13.56 MHz, for example.

This remote communication and identification technology is known as radio frequency identification (RFID).

Note that the module 56 may require to write data in the identification module 58 and to this end the amplitude modulation of the electromagnetic signal is then generated directly by the module 56 itself.

Note also that the identification tag 58 is known as an RFID tag.

To be more specific, the module 56 is, for example, an electronic component commercialized by Texas Instruments under the commercial reference HF reader system series 6000 S6700 Multi-protocol Transceiver IC.

This kind of component, also known as a transponder, manages the exchange of data and signals between the identification tag 58 and the transponder itself.

The identification tag is, for example, commercialized by Texas Instruments under the reference Tag-It HF-1 Transponder Inlay Rectangle-Miniature.

This component has a memory space of 2 kbits accessible in read mode and in write mode and contains for each component a unique identification number (main identification data) that is accessible only in read mode.

Once the identifier has been stored in the tag, it is therefore no longer possible to modify it.

When the tag is affixed permanently to a printer cartridge, the identifier of the tag constitutes a unique identifier of the printer cartridge itself.

The identification tag also contains secondary identification data that relates, for example, to the use of the cartridge in a given application, i.e. in a franking machine in the embodiment described here.

In the context of using the printer cartridge in a data printer unit of a franking machine, secondary identification data can be specific to the franking applications, for example.

FIG. 2 shows highly schematically an identification tag used in the FIG. 1 franking machine 10. Note, however, that a tag of this kind intended to be affixed to an inkjet printer cartridge provided with a print head according to the invention can be used outside the field of franking machines, more generally in printer units that receive confidential and/or sensitive data from external devices.

The presence of the identification tag on a printer cartridge of a printer unit of the above kind secures the printing of confidential and/or sensitive data in that authorization to print such data is accorded only if the printer cartridge has been identified unambiguously, by means of its identification tag, during a recognition procedure executed between the source of the confidential and/or sensitive data and said print member.

Referring again to FIG. 2, the identification tag 58 includes a substrate 60 that is thin and flexible, i.e. one that bends easily, on which are provided radio communication means constituting the communication function of the identification tag. The communication means consist of an integrated circuit 62 that implements the send and receive function and an antenna 64 that picks up the magnetic field.

In the above example of an identification tag the antenna 64 is at the periphery of the substrate 60, for example.

FIGS. 3*a* and 3*b* show diagrammatically the module 54 constituting the onboard intelligence of a printer cartridge according to the invention.

The module 54 takes the form of a thin double-sided printed circuit that is flexible, i.e. one that bends easily, to which is attached a thin miniature data processing unit 68.

The total thickness of the thin circuit 66 and the processing unit 68 must be sufficiently small that, when the intelligent module 54 is fixed to a standard inkjet printer cartridge 46, as described hereinafter with reference to FIGS. 4*a* to 4*h*, the bulk of the cartridge equipped in this way does not compromise the installation of the cartridge in the standard printer unit for which it is intended.

It is important that, when integrated into the printer unit, the printer cartridge forms with the components of the printer unit sufficient space to accommodate the circuit 66 equipped with the data processing unit 68.

The total thickness of the circuit 66 and the unit 68 is less than 1.5 mm, for example, enabling it to be integrated with a very large number of inkjet printer cartridges without modifying the geometry of the cartridge and its support.

The thickness of the data processing unit 68 is around 1 mm, for example (e.g. 0.9 mm), and that of the circuit 66 is less than 0.2 mm, for example.

However, for some applications where the overall size constraints relating to the installation of the cartridge on its support are less severe, a total thickness of the circuit 66 and the unit 68 from 1.5 to 2 mm can be envisaged, for example.

As shown in FIG. 3*a*, the circuit 66 includes on a front face a plurality of electrical contact areas 70*a* to 70*k* adapted to communicate with the processing unit 68 via respective conductive tracks 72*a* to 72*k*.

The contact areas 70*a* to 70*k* therefore receive the stream of printing commands 44 from the FIG. 1 printing control module 40 and send it to the processing unit 68.

As shown in FIG. 3*a*, the circuit 66 includes a plurality of conductive tracks that run from the processing unit 68 (in the bottom left-hand corner) to the opposite, rear face of the double-sided circuit, which is shown in FIG. 3*b*.

The circuit 66 has on the rear face a plurality of electrical contact areas 73*a* to 73*k* which are connected to the processing unit 68 via respective conductive tracks 75*a* to 75*k* that are partially represented in the left-hand portion of FIG. 3*a* and adapted to come into contact with the corresponding electrical contact areas 79 on the standard printer cartridge 46 shown in FIG. 4*a*.

Accordingly, after having analyzed the stream of printing commands 44 received via the electrical contact areas 70*a* to 70*k*, the processing unit 68 sends the commands successively via the conductive tracks 75*a* to 75*k*, the electrical contact areas 73*a* to 73*k*, and the corresponding electrical contact areas on the FIG. 4*a* printer cartridge, until they finally reach the print head of the cartridge, in order to control the printing operation.

Note that the FIG. 3*a* flexible circuit 66 has two portions that are delimited by two facing notches 74 and 76 on two parallel longitudinal edges of the support and define a bending line between those portions. As described later with reference to FIGS. 4*e* to 4*h*, the bending line allows the module 54 to be installed on two different regions of the exterior surface of the printer cartridge.

The printed circuit 66 has a first portion 67 carrying the electrical contact areas 70*a* to 70*k* and a second portion 69 carrying the processing unit 68.

Note that the processing unit 68 is implemented in programmed logic, which reduces its energy consumption.

The flexible printed circuit is made from a PTF polymer material approximately 0.125 mm thick, for example.

Note that the PTF technology employed is relatively economical and uses a polyester film for the dielectric and a silver-containing conductive ink to produce the conductive track previously cited.

This technology can produce multilayer circuits.

The data processing unit 68 is mounted on the printed circuit 66 by means of techniques known to the person skilled in the art for integrating an electronic component onto a circuit.

For example, the unpackaged component can be integrated into a TSSOP approximately 0.9 mm thick.

The component protected by its packaging is then transferred to the circuit by a technique known to the person skilled in the art and the connecting pins of the packaging are fixed to the conductive tracks of the circuit by a conductive glue which is, for example, isotropic.

The type of printed circuit used in accordance with the invention that can be permanently fixed to a printer cartridge is of the type sold by the company Parlex, for example.

FIG. 4*a* shows diagrammatically a standard inkjet printer cartridge 46, for example a Hewlett Packard HPc665x cartridge.

As the person skilled in the art knows, the cartridge contains an ink reservoir and a print head 50 with nozzles for ejecting ink onto the support to be printed.

As the person skilled in the art also knows, the cartridge has on its exterior surface electrical contacts 79 mounted on a thin circuit affixed to the cartridge, the electrical contacts being adapted to route the printing control signals to the print head to control the ink ejector nozzles.

Note that standard cartridges available off the shelf have no onboard intelligence and that in this case the printing control signals are therefore transmitted to the print head without analysis, in contradistinction to the present invention.

Figure 4B:
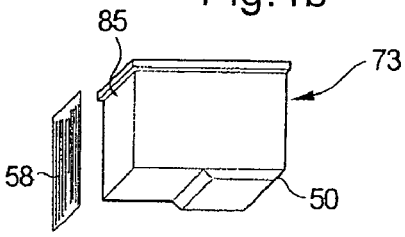
Figure 4C:
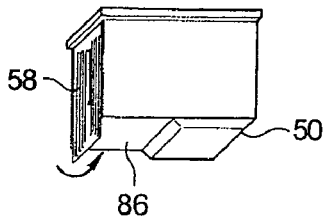
Figure 4D:
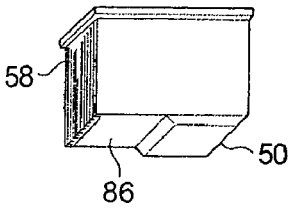
Figure 4E:
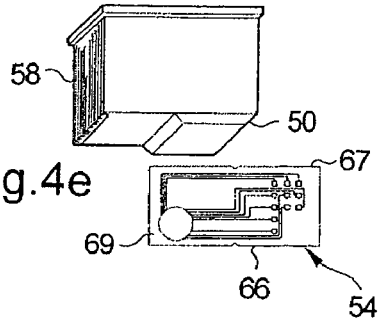
Figure 4F:
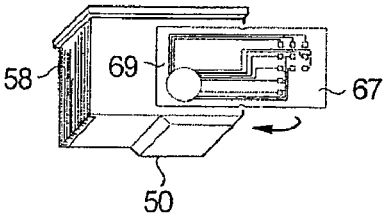

As shown in FIGS. 4*b*, 4*c* and 4*d*, the inkjet printer cartridge 46 shown in FIG. 4*a* is fitted with the identification tag previously described (the identification module 58 shown in FIGS. 1 and 2), for example by permanently gluing it to the exterior surface of the cartridge.

It is important for the substrate 60 of the identification tag to be fixed permanently to the cartridge, so that any subsequent attempt to remove the substrate, damages the communication means 62, 64 on it.

If the communication function of the identification tag is damaged, this makes it impossible for the source of confidential and/or sensitive data, for example the unit 12 for generating franking data in FIG. 1, to identify the printer cartridge concerned.

The person skilled in the art knows how to fix the substrate permanently to the cartridge, for example using glues available off the shelf, suited to the materials to be in contact, and providing a particularly intimate contact between the substrate and the exterior surface of the cartridge (FIGS. 4*c* and 4*d*).

As can be seen in the Figures, the identification tag 58 can be larger than a face 85 of the cartridge. In this case, thanks to the flexibility of the tag, it can be folded and one portion of the tag positioned on the face 85 and the other portion folded onto one of the adjacent faces 86 of the cartridge.

Once again, the identification tag 58 is particularly thin, enabling it to be integrated onto the exterior surface of the cartridge without modifying the overall external size of the latter to a degree that would compromise the installation of the cartridge in a standard printer unit.

The constraints on the thickness of the identification tag are the same as those previously indicated for the intelligent module 54.

The thickness of the tag is less than 1 mm, for example.

As shown in FIGS. 4*e* to 4*h*, the FIG. 3 printed circuit 66 is permanently fixed to the exterior surface of the printer cartridge to prevent insertion of an external element between the circuit and the cartridge itself.

To this end, the circuit 66 can be glued intimately to the exterior surface of the cartridge, for example, so that any attempt to remove the circuit 66 by unsticking it damages it and therefore makes it impossible for a fraudster to use the cartridge.

Figure 4G:
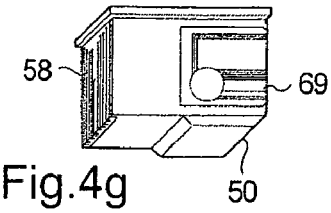
Figure 4H:
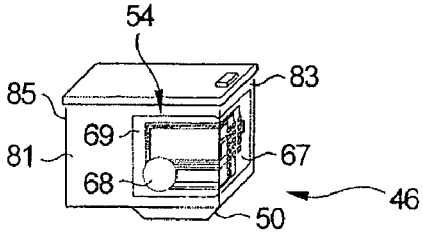

More particularly, the second portion 69 of the thin printed circuit 66 carrying the data processing unit 68 is first applied to one of the exterior faces 81 of the cartridge (see FIG. 4*f*), while the first portion 67, carrying the electrical contact areas, is applied to an adjacent face 83 of the cartridge (see FIGS. 4*g* and 4*h*).

It will be noted that the second portion 69 of the thin circuit 66 is preferably affixed to a region of the exterior surface of the cartridge which, when the cartridge is integrated into a printer unit, defines with the components of the printer unit sufficient space to accommodate the data processing unit 68.

Accordingly, assuming that, when the printer cartridge is integrated into a printer unit, the space in front of the external faces of the cartridge is larger in front of the face 85 of the cartridge that is opposite the face 83, it is then possible for the circuit 66 to extend from the face 83 as far as the opposite face 85 and for the data processing unit 68 to be positioned facing that face.

Of course, in this situation, the identification tag 58 must then be positioned on another free region of the exterior surface of the printer cartridge.

It should be noted that the flexibility of the modules 54 and 58 is optimally exploited so that these modules can espouse the available exterior surface of the cartridge as closely as possible.

Thus the flexibility of each module enables it to adapt to the geometry of the cartridges and to the constraints associated with the installation of the cartridges into their support in the printer unit.

However, in some applications, flexibility of one or both of the two modules 54 and 58 is not a requirement, and consequently it suffices for the module or modules to be thin.

Note that, when the intelligent module 54 (or the identification module 58) is affixed to a single face of the cartridge according to the invention, the property of flexibility of the corresponding module is less important, and may even not be necessary.

Thus the disposition of the thicker portion of the FIG. 3 intelligent module 54 depends on the free space around the printer cartridge when it is installed in a printer unit.

Note that the FIG. 4*h* inkjet printer cartridge 46 is equipped with an identification module enabling an external device (a source of confidential and/or sensitive data) to identify the cartridge, and with an intelligent module, these modules each having particular means of making the cartridge secure.

Note that the inkjet printer cartridge according to the invention can be used in other applications in which it is not necessarily equipped with the identification module 58.

Equipment of the above kind affixed to a standard inkjet printer cartridge available off the shelf is particularly advantageous in that it does not call into question the design of the cartridge or its overall outside dimensions.

The inkjet printer cartridge according to the invention, equipped with an intelligent module 54, and where applicable with an identification module 58, can be used outside the field of franking machines, and in particular in printer units that receive confidential and/or sensitive data from exterior devices.

In the FIG. 1 franking machine, the data is made secure firstly by the authentication of the printer cartridge 46 by the data generating unit 12.

To this end, the unit 12 obtains data identifying the print member 46 using the wireless communication mode described above.

When the central unit 18 of the unit 12 has verified that the print member 46 is an authorized printer cartridge, the module 20 then generates a franking data signature using a mathematical method known to the person skilled in the art. The encryption circuit 22 of the module 20 then encrypts the signature generated in this way, for example using 3DES encryption, which is known to the person skilled in the art.

This kind of encryption requires the sender and the receiver to hold different encryption keys that are 128 bits long in the case of 3DES encryption.

Because decryption is effected in the processing unit 68 of the module 54, a key is written into the unit 68 when manufacturing the module 54.

This key must also be known to the sender, and therefore contained in the encryption circuit 22.

The sender 12 uses the key to encrypt the data and the receiver 54 uses it to decrypt the data.

The key can be programmed when installing the module 54 on the printer cartridge or programmed directly into the processing unit 68 during manufacturing of the module 54.

When the signature is encrypted, the unit 18 associates with it, for example concatenates with it, franking data and transmits the whole of the data, which constitutes the stream 42, over the communication link 38.

Note also that, in the embodiment described, there is no encryption as such of the franking data to be printed, although this is of course possible in a different embodiment.

Franking data to be printed can additionally be encrypted, which makes the exchange of this data between the unit 12 and the printer unit 14 more secure.

However, encryption should not be used if it necessitates too great a volume of computation, in that the processing unit 68 of the module 54 diverts the energy necessary for it to function from the printing control signals reaching it.

Figure 5:
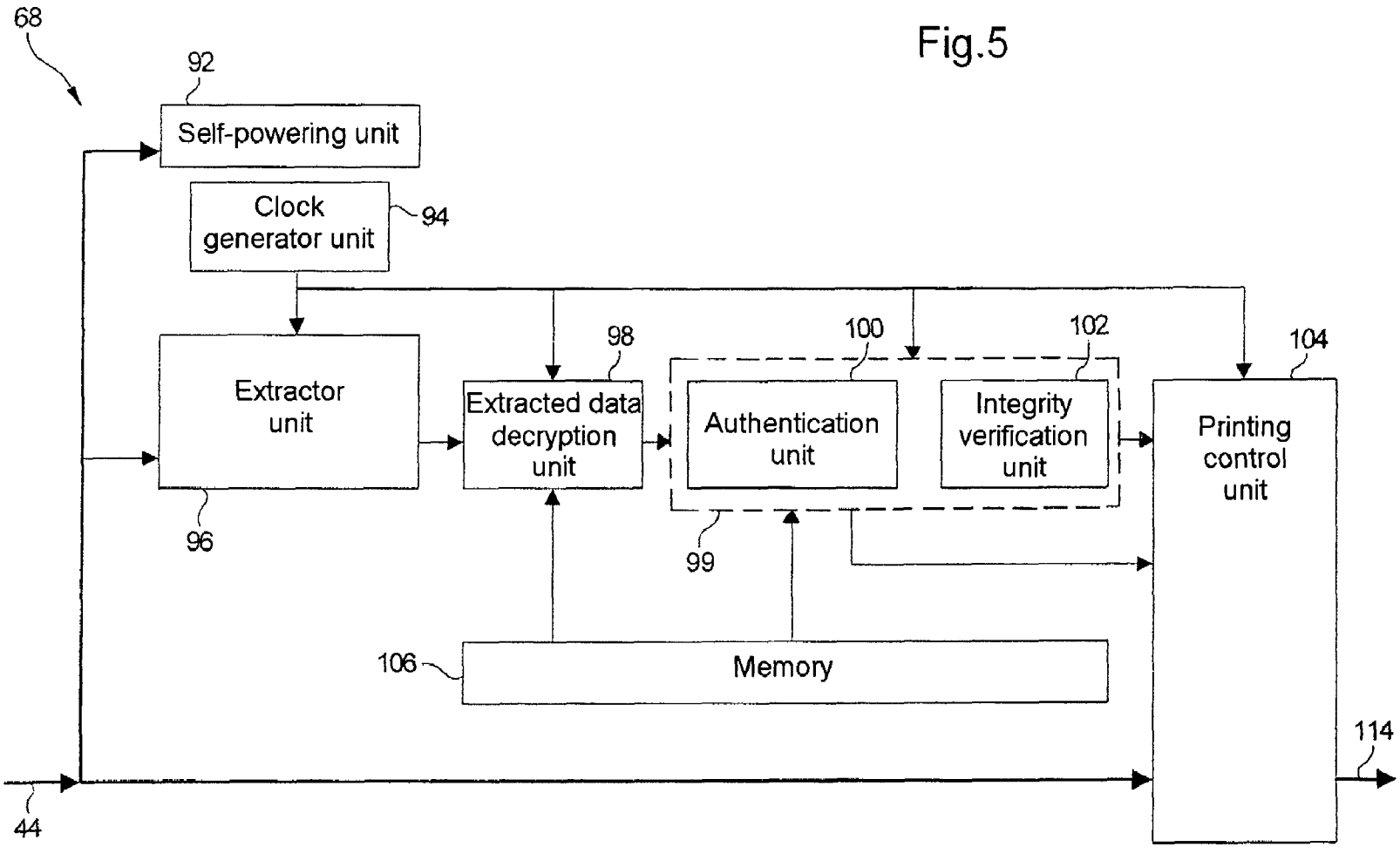
FIG. 5 is a diagrammatic view of the data processing unit of the intelligent module 54 of FIG. 3.

FIG. 5 shows diagrammatically functional units of the FIG. 3*a* data processing unit 68.

As shown in FIG. 5, the data processing unit 68 receives the FIG. 1 stream of printing commands 44 and analyzes it, in particular to authenticate the data to be printed.

As mentioned above, the energy necessary for the processing unit to function is diverted from the stream of printing control signals.

The data processing unit could use a microprocessor provided that there is no risk of the energy diverted degrading the printing of data.

Thus the processing unit 68 includes a self-powering unit 92 and a clock generator unit 94 that supply a particular clock frequency to each of the various units described next.

A unit 96 extracts the encrypted signature from the stream 44 of printing commands reaching the data processing unit 68 and decrypts this signature.

This is possible because the encryption key or keys are also known to the processing unit 68, because they are programmed either during manufacturing of the module 54 or when it is affixed to the print member 46.

Decryption is effected by the decryption unit 98.

The data processing unit 68 also includes a circuit 99 that includes an authentication unit 100 for authenticating the data to be printed on the basis of the analysis of the decrypted signature of the franking data.

As a matter of fact, when the unit 100 registers the presence of the signature of the franking data in the stream of printing commands, this proves the authenticity of the data to be printed.

Note further that the unit 12 for generating franking data is thereby indirectly authenticated by the printer cartridge.

It is possible to use only one level of verification, and thus to decide to authorize the printing of data as soon as the data to be printed has been authenticated.

A supplementary level of verification can also be provided, by way of the unit 102 that verifies the integrity of the data to be printed to check that, even if the data comes from an authentic source, it has not been tampered with after leaving the source.

To this end, tests are applied to the data present in the stream of printing commands.

When the integrity of the data to be printed has been recognized, then the unit 104 authorizes printing of the data.

On the other hand, if the data has not been authenticated by the unit 100 or the integrity of the authenticated data has not been recognized by the unit 102, then the unit 104 decides either not to authorize printing of the data or to generate an erroneous and therefore unusable franking mark.

To be more specific, note that the data processing unit 68 first prints a few lines of franking data, for example, and then analyzes some of the data extracted from the stream of printing commands, after which, as a function of the result of the analysis, it can authorize the printing of further lines and again analyze other data extracted from the stream of printing commands, and so on.

It should be noted that the data processing unit 68 also includes a non-volatile memory 106 whose main function is to store the dynamic values of the application, for example the cartridge manufacturing date, and the like, and where applicable to store values generated by the units 98,100 and 102.

Figure 6:
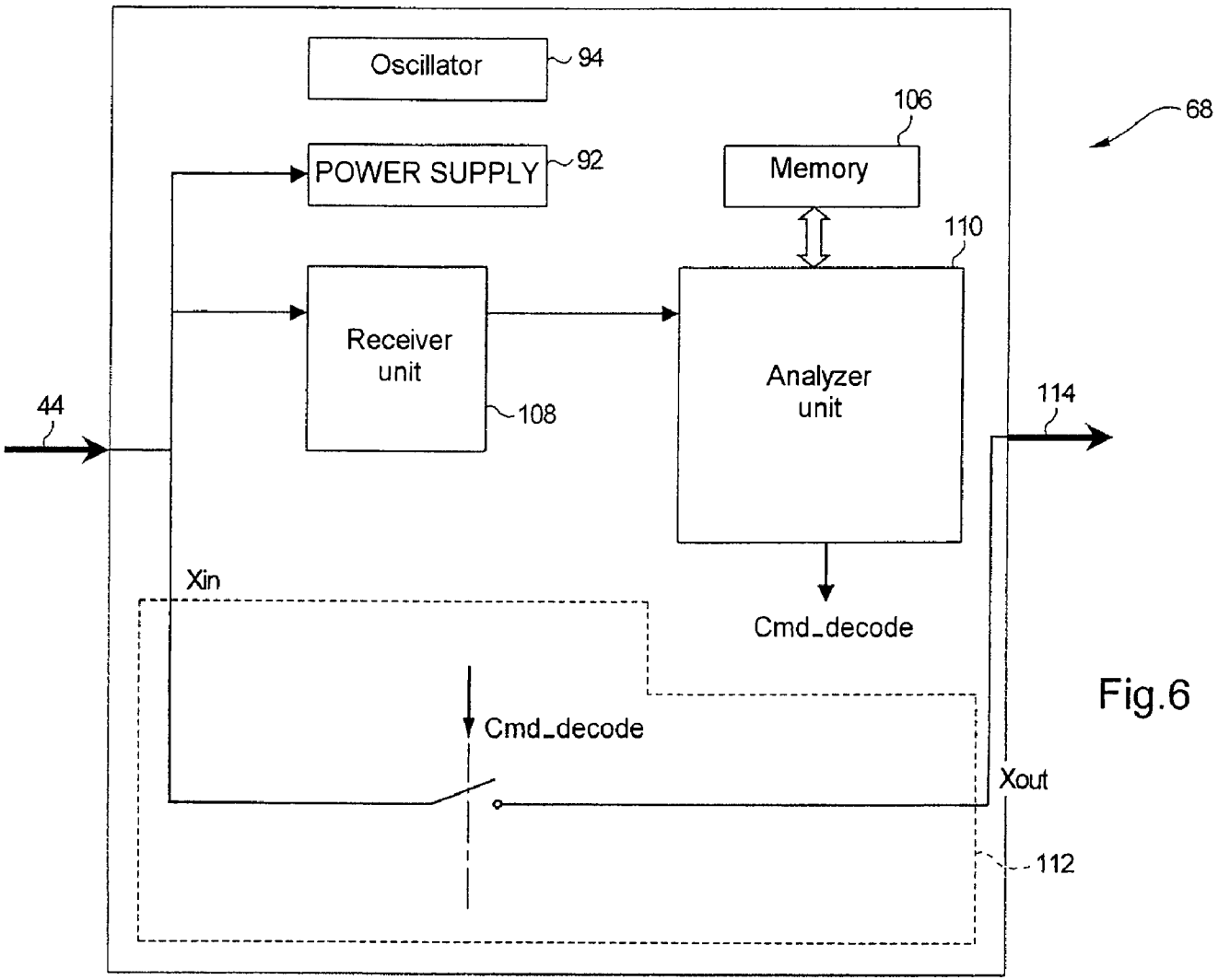
FIG. 6 is a more detailed view of the unit 68 of the data processing unit of FIG. 5.

FIG. 6 shows in more detail some of the components constituting the FIG. 5 data processing unit 68.

The data processing unit 68 includes a serial receiver unit 108 notably including a buffer memory for the intermediate storage of data extracted from the stream 44 of printing control signals.

As shown, some of the printing control signals are used by unit 92 for self-powering the data processing unit 68.

A unit 110 for analyzing data extracted from the printing control signals and combining various functions executed by the units 98, 100, 102 and 104 in FIG. 5 supplies a signal Cmd-decode.

A circuit 112 including a logic switch selectively authorizes the passage of a signal Xout, on the basis of a printing control signal Xin, as a function of the value of the control signal Cmd-decode.

The Cmd-decode signal is produced for one or more lines of franking data and, for example, authorizes the passing and therefore the printing of a given number of lines of franking data that constitute the franking mark.

Note that the circuit 112 constitutes a pattern that is repeated several times according to the number of signals Xin obtained from the printing control signals.

The stream 114 of printing commands from the unit 68 is then transmitted to the print head 50 to control the print nozzles.

Figure 7:
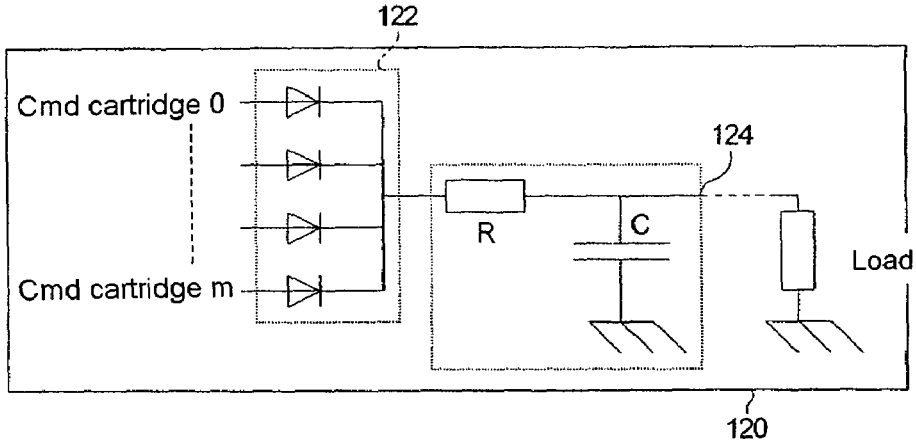
FIG. 7 is a detailed diagrammatic view of the self-powering unit 92 from FIGS. 5 and 6.

FIG. 7 shows diagrammatically the self-powering principle of the FIG. 6 unit 92.

Thus the FIG. 7 circuit 120 includes a set 122 of (m) diodes in parallel and each receiving one of the control signals Cmd cartridge 0 to Cmd cartridge m, each of which corresponds to data specific to one line of the image to be printed.

The set 122 of diodes implements an "OR" logic function which therefore authorizes the delivery of a signal when its state is 1.

The control signal that is allowed to pass is then filtered in a filter 124 in which the values of the components R, C are determined as a function of the value of the "load" of the circuit of the unit 68, to allow the accumulation of energy.

Figure 8:
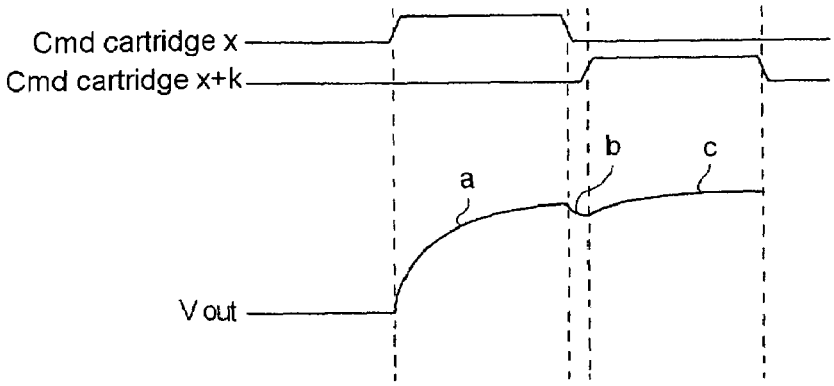
FIG. 8 shows timing diagrams of various signals for generating a self-powering signal Vout.

FIG. 8 shows timing diagrams for loading the unit 68.

Thus, as shown by the evolution of the output signal Vout of the self-powering unit, the latter signal is generated (portion a) by the detection of a first rising edge of a control signal Cmd cartridge x. When that control signal goes to 0, the self-powering signal Vout loses a little energy (portion b), but the energy level begins to rise again (portion c) after the detection of a rising edge of the next control signal Cmd cartridge x+k.

Note also that the control signals generated by the unit 12 and intended for controlling the print head 50 can have an amplitude of the order of 20 V, and the processing unit 68 therefore uses a high-voltage technology.

The core of the unit 68, which is an application-specific integrated circuit (ASIC), for example, operates at a voltage of 3.3 V or 5 V, for example, and incorporates memory in the form of RAM or EEPROM.

What is claimed is:

1. An inkjet printer cartridge (46) comprising at least one print head (50) for printing data on a support (17), wherein a thin printed circuit (66) is permanently fixed to the printer cartridge and a miniature data processing unit (68) fixed to said thin printed circuit analyzes a stream (44) of printing commands for controlling the print head to authenticate data to be printed on the support.

2. A printer cartridge according to claim 1, wherein the thin printed circuit is flexible.

3. An inkjet printer cartridge according to claim 1, wherein the data processing unit (68) includes means (100) for verifying the presence in the stream of printing commands the data for authenticating data to be printed.

4. An inkjet printer cartridge according to claim 3, wherein the data processing unit includes means for deciding whether or not to authorize the printing of data according to the result obtained by the verification means.

5. An inkjet printer cartridge according to claim 1, wherein the data processing unit includes means (102) for verifying the integrity of the data to be printed.

6. An inkjet printer cartridge according to claim 1, wherein an energy necessary for the data processing unit to function is obtained from the stream of printing commands.

7. An inkjet printer cartridge according to claim 1, wherein the data processing unit is implemented in programmed logic.

8. An inkjet printer cartridge according to claim 1, wherein the thin printed circuit (66) is glued to an exterior surface of the printer cartridge.

9. An inkjet printer cartridge according to claim 1, further comprising:

the exterior surface including electrical contacts (79) connected to the print head to transmit thereto the printing commands for printing data on the support.

10. An inkjet printer cartridge according to claim 9, wherein the thin printed circuit has a first portion (67) carrying electrical contacts adapted to receive the stream of printing commands and connected to the data processing unit, and which is on a first region of the exterior surface of the cartridge.

11. An inkjet printer cartridge according to claim 10, wherein the thin printed circuit has a second portion (69) on which the data processing unit is mounted and which is on a second region of the exterior surface of the printer cartridge.

12. An inkjet printer cartridge according to claim 11, wherein the second portion of the thin printed circuit is on a second region of the exterior surface of the printer cartridge which, when said printer cartridge is integrated into a printer unit, forms with the components of said printer unit sufficient space to accommodate the data processing unit.

13. An inkjet printer cartridge according to claim 9, wherein the thin printed circuit has two opposing faces and wherein one of the faces of the thin printed circuit in contact with the cartridge includes electrical contact areas connected to the electrical contacts connected to the print head and to the data processing unit on the opposite face of the thin printed circuit.

14. An inkjet printer cartridge according to claim 13, wherein the opposite face carrying the data processing unit includes electrical contacts adapted to receive the stream of printing commands.

15. An inkjet printer cartridge according to claim 1, wherein the thin printed circuit is double-sided.

16. An inkjet printer cartridge according to claim 1, wherein the data processing unit is thin.

17. An inkjet printer cartridge according to claim 16, wherein the total thickness of the data processing unit and the thin printed circuit is less than or equal to 1.5 mm.

18. A data printer unit comprising an inkjet printer cartridge according to claim 1.

19. A franking machine including a unit for generating franking data to be printed and a printer unit receiving franking data from said data generating unit, characterized in that the printer unit includes an inkjet printer cartridge according to claim 1.

* * * * *